United States Patent [19]

Ross et al.

[11] Patent Number: 4,852,659

[45] Date of Patent: Aug. 1, 1989

[54] MOTOR GRADER WITH HIGH-LIFT AND LOCK ARRANGEMENT

[75] Inventors: Murray A. Ross; Gordon L. Adams; Michael A. Sully, all of Goderich, Canada

[73] Assignee: Champion Road Machinery Limited, Goderich, Canada

[21] Appl. No.: 16,085

[22] Filed: Feb. 18, 1987

[51] Int. Cl.[4] ..... E02F 3/76

[52] U.S. Cl. ..... 172/789; 172/793; 172/797

[58] Field of Search ..... 172/789, 791, 792, 793, 172/795, 797

[56] References Cited

U.S. PATENT DOCUMENTS

| | | | |
|---|---|---|---|
| 2,655,743 | 10/1953 | Ross | 172/793 |
| 3,455,400 | 7/1969 | Hanser et al. | 172/793 |
| 4,340,119 | 7/1982 | MacDonald | 172/789 |

FOREIGN PATENT DOCUMENTS

| | | | |
|---|---|---|---|
| 180707 | 9/1962 | Sweden | 172/793 |

OTHER PUBLICATIONS

"JD670-A", brochure by Deere & Co., Moline, Ill.

"Caterpillar 140 G Motor Grader", Caterpillar Ins., Peoria, Ill., pp. 314,315,330,331.

"GD825A-1", Komatsu, Tokyo, Japan.

"Champion 710", brochure by Champion, Ltd., Goderich, Ontario, Canada.

"Champion 720/720A", brochure by Champion Ltd., Goderich, Ontario, Canada.

"Champion All Wheel-Drive C4+2", brochure by Champion, Ltd., Goderich, Ontario, Canada, Published 1984.

*Primary Examiner*—Richard T. Stouffer

[57] ABSTRACT

A blade lift and support system for a road grader is taught which is of simplified construction and improved geometry. According to one embodiment, the adjustment of the beam and associated grader blade is fully hydraulically controlled including locking of the beam in a desired position and maintaining the beam position by an hydraulic fluid lock. This preferred arrangement permits full power adjustment of the high-lift while the blade is in a lifted condition. The particular beam shape improves the position of the cylinders to effect positioning the blade for working.

20 Claims, 7 Drawing Sheets

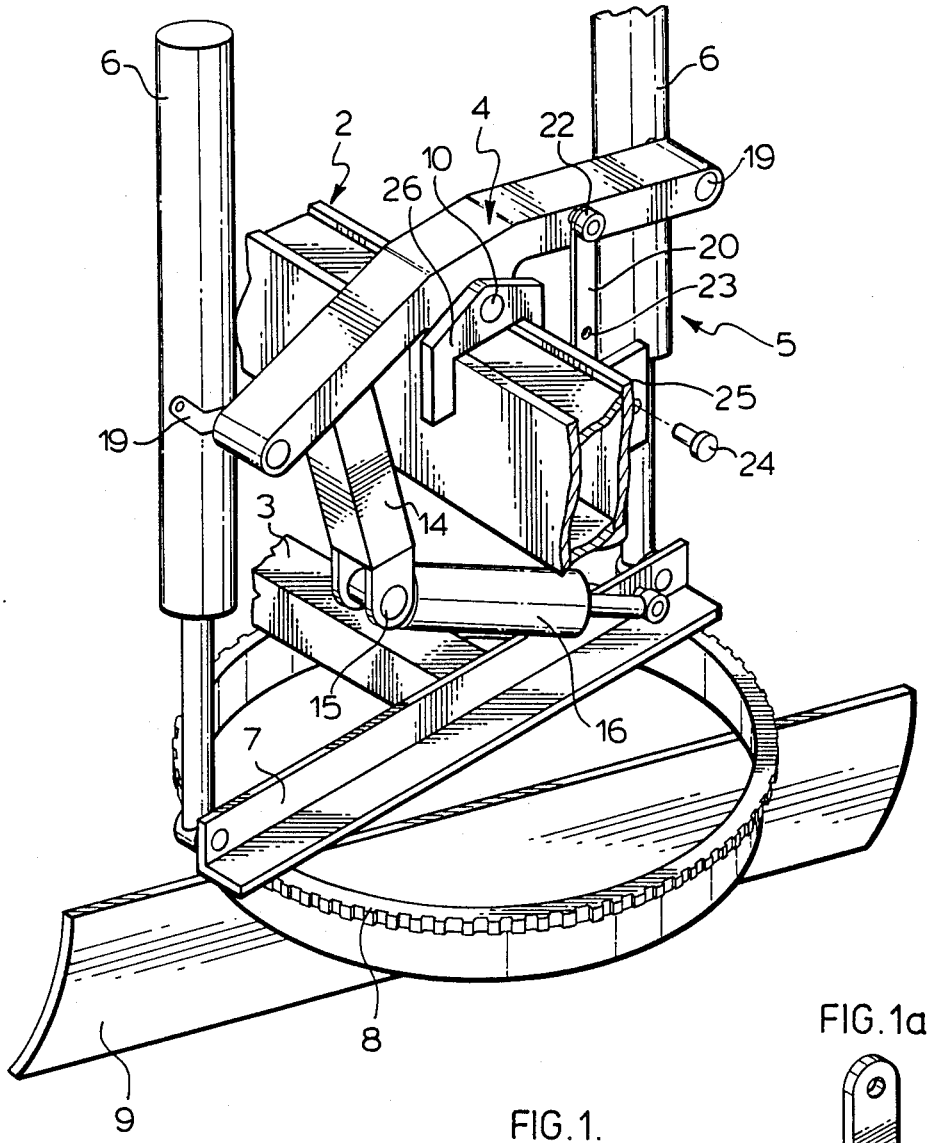
FIG. 1.
FIG. 1a.
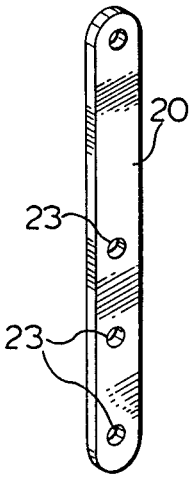

MOTOR GRADER WITH HIGH-LIFT AND LOCK ARRANGEMENT

BACKGROUND OF THE INVENTION

The present invention relates to high-lift arrangements for a blade of a motor grader. In particular, the invention relates to an improved method of supporting the blade beneath the frame of a grader.

In the past a number of arrangements have been proposed for supporting the blade of a motor grader and in general these can be broken into two groups. The first group uses a beam extending either side of the frame of the motor grader and pivotable about the frame, and the second group uses separate arms, one to either side of the frame, and in many cases these arms are movable to various positions. There has also been a number of arrangements where either the beam or the arms are fixed in position on the grader frame. The fixed position arrangements are generally limited with respect to the extent and position, either side of the grader, that the blade can be positioned. In general, the most demanding specification requires that the grader blade be capable of moving to either side of the mainframe of the grader from a perpendicular position at one side to a perpendicular position at the other. The fixed arm or fixed beam arrangement have limited adjustability, however in many applications the extreme positions of the blade will not be used. The blade support arrangement should be adjustable to effect 2 to 1 and 1 to 1 banking either side of the grader as well as a ditching orientation either side of the grader.

In addition to the very demanding specifications set forth above which have generally been met with either the pivoted beam or the movable arms, the support arrangement for the motor grader blade should be convenient to use and adjust between the various positions. The system should be such that there is not any substantial fouling problems with respect to the movement of the cylinders to achieve the various positions, as fouling problems can lead to extensive damage of the hydraulic components and other structural components. Furthermore, the support arrangement for the blade of the motor grader must take into account the visibility of the operator from the cab and certain specific points of the blade which are considered somewhat critical. For bank grading, it is generally noted that the heel of the blade should be positioned outside of the wheels so that the wheels do not contact the graded surface and, therefore, the heel of the blade should be visible for this particular operation. Furthermore, the toe of the blade should be visible as this is the other extreme position that is being graded.

The ideal blade positions include the 90° high-lift to either side of the grader, a position of the blade which is approximately 63° to effect a 2 to 1 banking operation, and a further banking position of the blade at about 45°. The 45° position and the 63° position are generally considered the most frequent positions of the grader blade and the positions which a system must satisfy. Therefore, the flexibility of the system and the ease of adjusting the same should be evaluated with respect to these normal positions, although some merit must be accorded the 90° position as well as the horizontal beam position.

Our earlier patent, U.S. Pat. No. 4,340,119 uses a beam centrally pivoted atop the grader frame with a locking arrangement generally provided beneath the frame. This arrangement generally satisfies the standards set forth above, however the locking arrangement beneath the frame, which is a mechanical arrangement, reduces the clearance beneath the frame and requires a fair degree of accuracy with respect to the locking position of the beam when the beam position is adjusted. The advantages of this mechanical lock are the steel to steel locking contact which is the generally accepted standard in the industry.

The structure previously referred to above, having movable arms either side of the grader frame, again uses a pin-type lock arrangement for fixing the arms at various positions relative to the frame and often these pins are either mechanically movable to allow adjustment of the arms or beam or are hydraulically actuated to effect adjustment of the components. However, the fixing of these components in a predetermined position on the frame is achieved by a mechanical type lock. The problem of accurate positioning for locking is compounded in the movable arm system in that two arms must be locked rather than a single beam and freezing of locks occurs making the arms difficult to release.

SUMMARY OF THE INVENTION

The present invention provides a structure for supporting the blade of a motor grader beneath the frame of the grader. This arrangement is of reduced complexity and provides advantages with respect to cost of manufacture as well as service in the field. The arrangement maintains the area beneath the frame of the grader relatively clear and uses a link-type member disposed between the side of the grader frame and a position on the beam spaced from the central pivot location of the pivoted beam to effect locking. In a preferred embodiment of the invention, the link is an hydraulic cylinder thus allowing an infinite number of positions of the beam relative to the grader frame. The hydraulic cylinder also acts as an hydraulic lock, thus overcoming the precision problems associated with a mechanical lock.

BRIEF DESCRIPTION OF THE DRAWINGS

Preferred embodiments of the invention are shown in the drawings wherein;

FIG. 1 is a partial perspective view of a high-lift arrangement for the blade of a motor grader;

FIG. 1*a* is a perspective view of manual lock link;

DETAILED DESCRIPTION OF THE PREFERRED EMBODIMENTS

Figure 2:
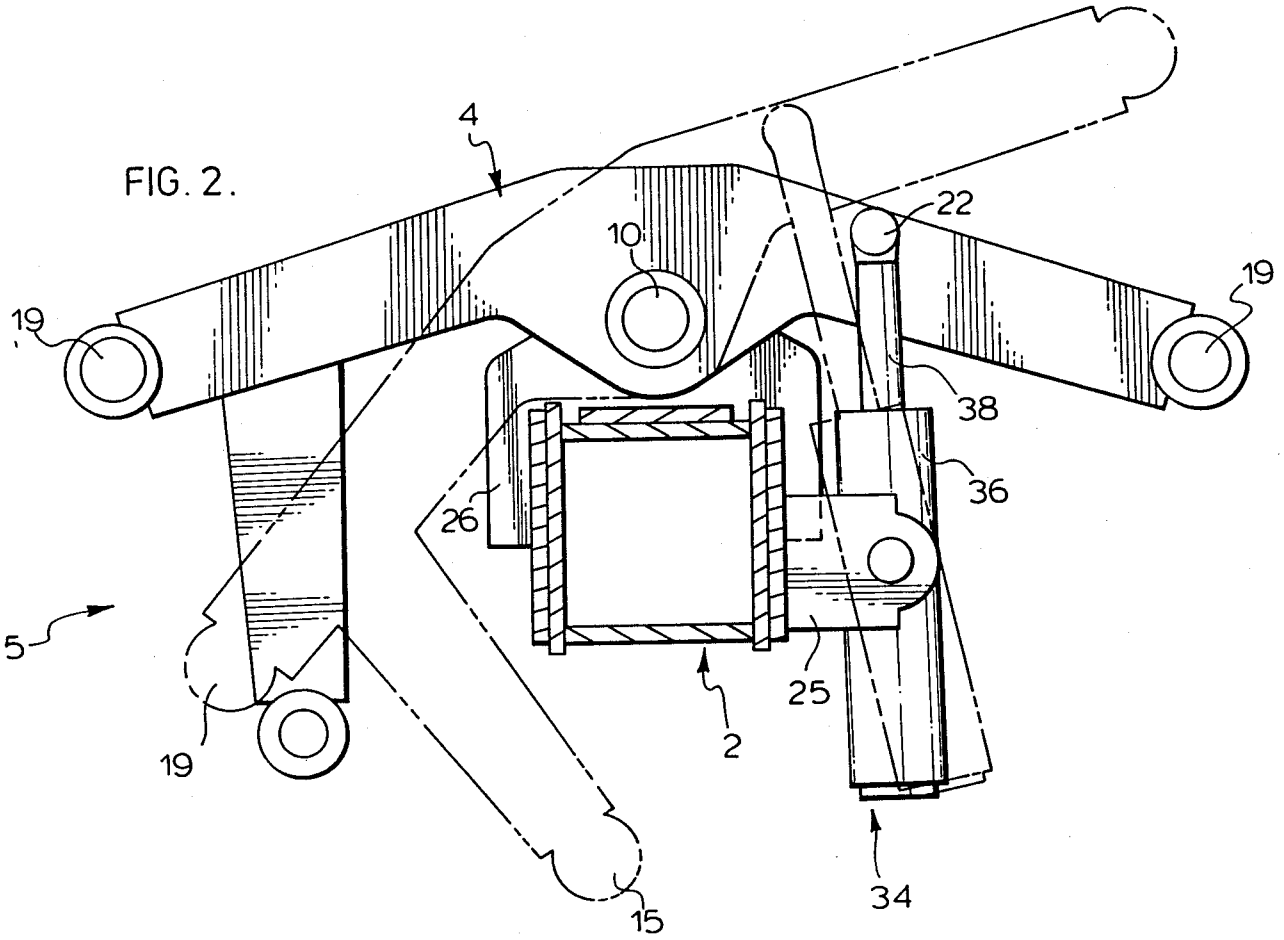
FIGS. 2 and 3 are rear elevational views of the high-lift.

The mainframe 2 of the motor grader supports adjacent the cab a generally horizontally extending support beam 4, which universally supports at 19 hydraulic lift cylinders 6 at either end of the support beam. The cylinders 6 are connected to a ring gear 8 via beam 7 which provides the main support of the road grader blade 9. Beam 7 is pulled by the grader by means of drawbar 3. The arrangement for supporting of the blade 9 beneath the ring gear and the ring gear are known from our earlier patent U.S. Pat. No. 4,340,119 and the prior art in general. The invention of the present application is generally directed to the high-lift arrangement 5 for the blade 9. The support beam 4 is pivotally supported on the shaft 10 which extends in the fore and aft direction of the mainframe of the road grader. The shaft 10 is secured to the mainframe 4 by two pivoted saddle arrangements 26 to either side of the beam 4. The beam itself intermediate the saddles 26 includes a downwardly extending portion which includes bearings for cooperation with the shaft 10 to thereby pivotally secure the beam 4 atop the mainframe 2 of the motor grader. The beam 4 rotates from the generally horizontal position of FIG. 1 through an angle of about 70°, 35° either side of the horizontal position. The lift cylinders 6 are universally supported adjacent the extremities of the beam 4 at a position generally below shaft 10 (when the beam is horizontal). In this way, the points of securement are such that with a counterclockwise rotation of the beam 4 shown in FIG. 2, the point of securement 19 of the lefthand cylinder is below the horizontal line passing through shaft 10 and as such, will move through a further distance toward the frame 4 of the grader for a predetermined amount of rotation. This is desired as problems occur in achieving the 90° location and these problems are reduced by positioning the cylinders such that the far cylinder in a 90° blade position is moved as far as possible beneath the frame of the grader, while the other cylinder is rotated upwardly through the horizontal passing through shaft 10 and as such, its position is still quite spaced from the mainframe. Therefore, by positioning the support positions of hydraulic cylinders 6 below the horizontal line passing through shaft 10, advantages are achieved with respect to both cylinders when considered with respect to the requirement to position the blade at 90° to either side of the motor grader. The preferred separation of the cylinders is fifty inches.

Figure 4:
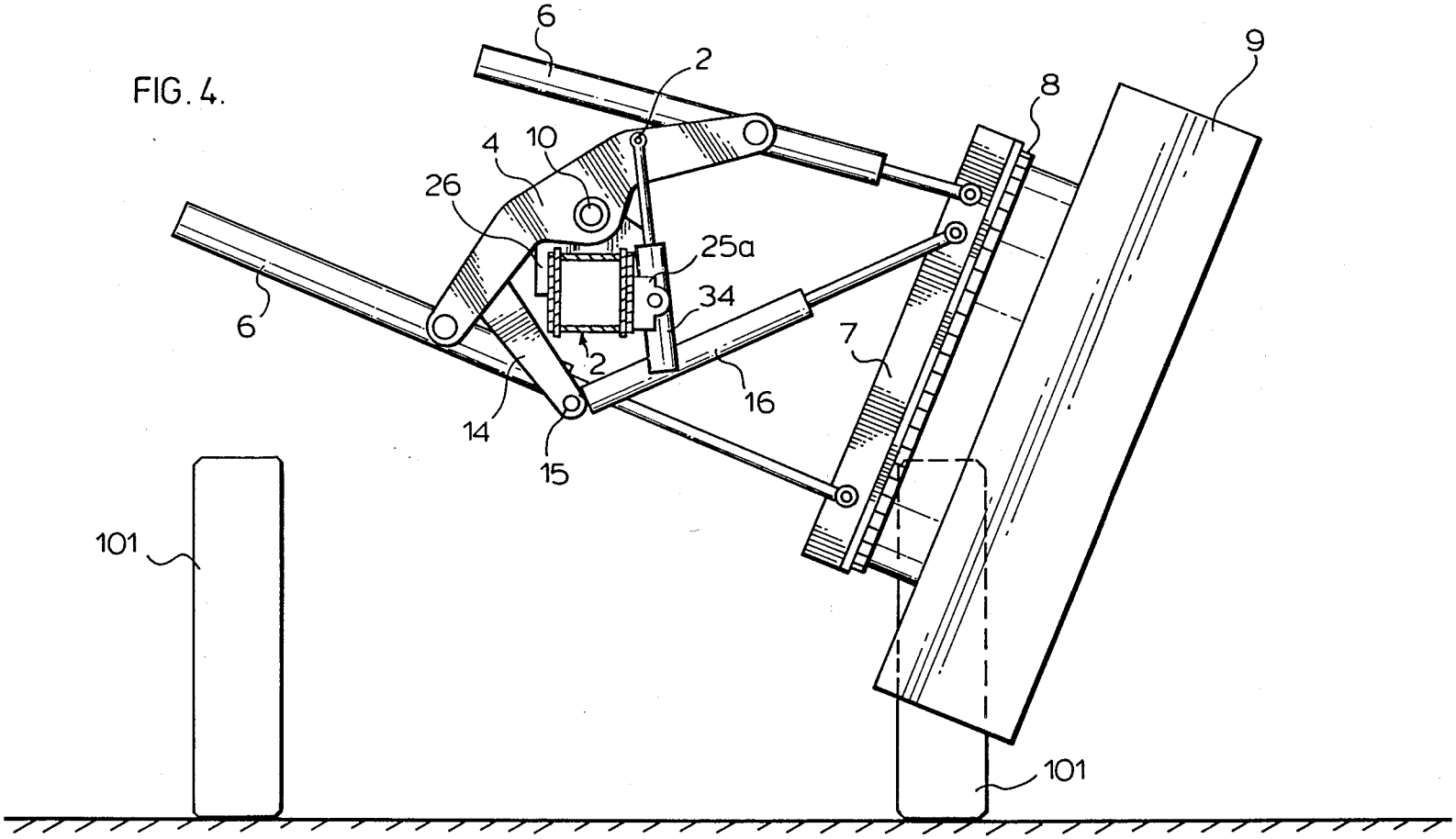
FIG. 4 is a similar rear elevational view with the high-lift rotated to one side of the motor grader.

Integral with beam 4 and to one side of the mainframe 2 is a downwardly and rearwardly extending arm 14 having an end 15 which is rearwardly offset relative to the center line of the beam 4 about eight inches. An hydraulic shift cylinder 16 is secured to the end 15 and shifts the ring gear 8 in a generally traverse movement relative to the mainframe 4. In this way, the position of the blade, either beneath the grader or to the side thereof, is accomplished. As can be seen from the figures, arm 14 is spaced from the mainframe of the grader when the beam is in the generally neutral position (i.e. with the beam generally symmetrically disposed to extend generally equally to either side of the frame) and is positioned to allow, without interference, the desired rotation of the beam about shaft 10. To the other side of the frame 4 as shown in FIG. 1 and FIG. 1*a*, is a lock link 20 which is pivotally secured to the beam at position 22. The other end portion of the lock link is pinned or secured to the side of the frame 4 of the grader by pin or securing means 24. Thus, the lock link, beam, and frame can form a fixed three bar linkage. The link 20 includes a number of circular holes 23 in the length thereof which are positioned to achieve the desired fixed positions of the beam relative to the grader. In this case, the link provides a manual type lock arrangement where it would be necessary for the operator to remove the pin 24 and cause rotation of the beam 4 to the desired position and effect locking by replacing the pin 24 in an appropriate aligned aperture in flange 25. This lock link arrangement pinned to the side of the mainframe of the grader maintains the space beneath the road grader substantially clear and allows the ring gear 8 to essentially come immediately below the grader frame (with five inches) to effect a fairly high ground clearance of the blade directly beneath the frame as schematically shown in FIG. 4. Furthermore, this simple lock arrangement greatly reduces the cost and it can be recognized that advantages are achieved in that if wear does occur, either pin 24 or the various connections of the link 20 to the beam 4 or the beam to the frame can be accomplished quite easily. The bearings type connection associated with each of these components are common and are readily available and easily replaced by the people in the field. Such is not the case in prior art structures where, in some cases, a very large bearing is placed completely about the frame of the grader with a beam rotating about the center axis of the frame. The point of securement of the link 20 to the beam 4 is spaced from the shaft 10 to reduce the stress concentration on the beam 4 at securement point 22. However, the beam can withstand substantial stress and the position of lock arrangement, generally close to the mainframe of the grader, improves visibility of the blade beneath the grader frame. For example, the link 20 could be positioned further along the beam 4, thus increasing the distance between securement point 22 and shaft 10, however this then obstructs a further area beneath the beam 4 whereby visibility of the operator is marginally reduced and stress is significantly reduced. Therefore, the position as shown, which is generally within about 12 inches of the shaft 10, does concentrate or provide a high stress area at point of securement 22, however, for light application, this can be accommodated in the design of the securement of the link 20 to the beam.

Figure 3:
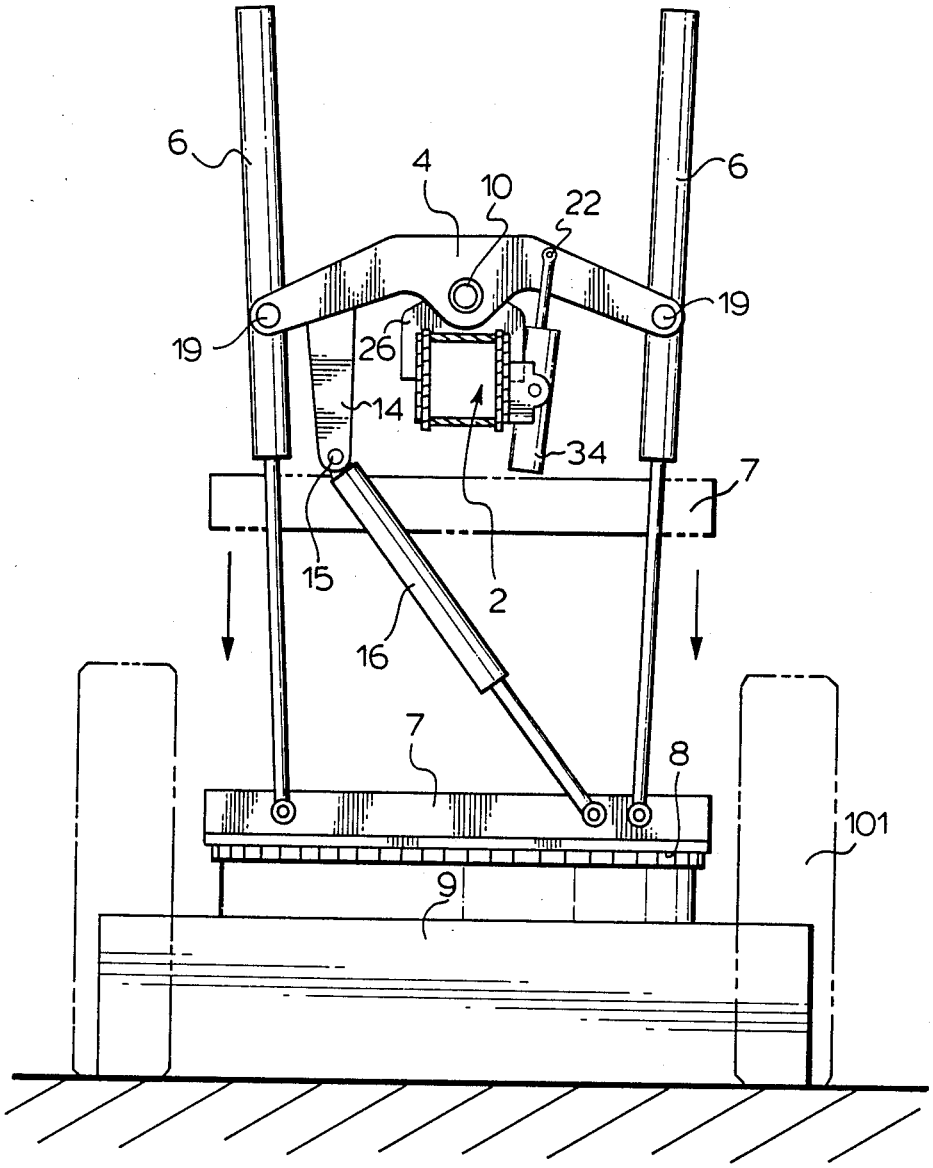

In the embodiment of the invention as shown in Figures 2 through 4, the link 20 has been replaced by a double acting hydraulic cylinder 34 generally universally supported to the side of the frame 2 of the grader via flange 25. The cylinder 34 has been secured intermediate the length of the barrel portion 36 to allow for a somewhat greater stroke of the cylinder. The piston 38 of the cylinder 34 is secured at point 22 to the beam whereby the position of the beam relative to the mainframe 4 is accomplished by adjusting the cylinder. This results in an arrangement which effectively provides an infinite number of positions of the beam between its extreme points of rotation, with the locking of the beam being accomplished by the hydraulic cylinder 34. It is also possible to introduce an hydraulic pressure relief switch whereby if forces are encountered exceeding the maximum design, the relief valve would be actuated momentarily releasing lock cylinder 34 to avoid damage. The hydraulic cylinder 34 thus allows powered positioning of the beam and does not require the resting of the blade on the ground to effect adjustment. In most prior art arrangements, it has been essential to place the blade on the ground and allow the remaining cylinders to move in response to repositioning of the beam, with the beam subsequently being locked, whereafter the other hydraulic components can be adjusted as necessary. Such is not the case with the hydraulic control arrangement of the beam of the present invention, as hydraulic cylinder 34 is under power and allows positioning of the blade as desired.

Figure 5:
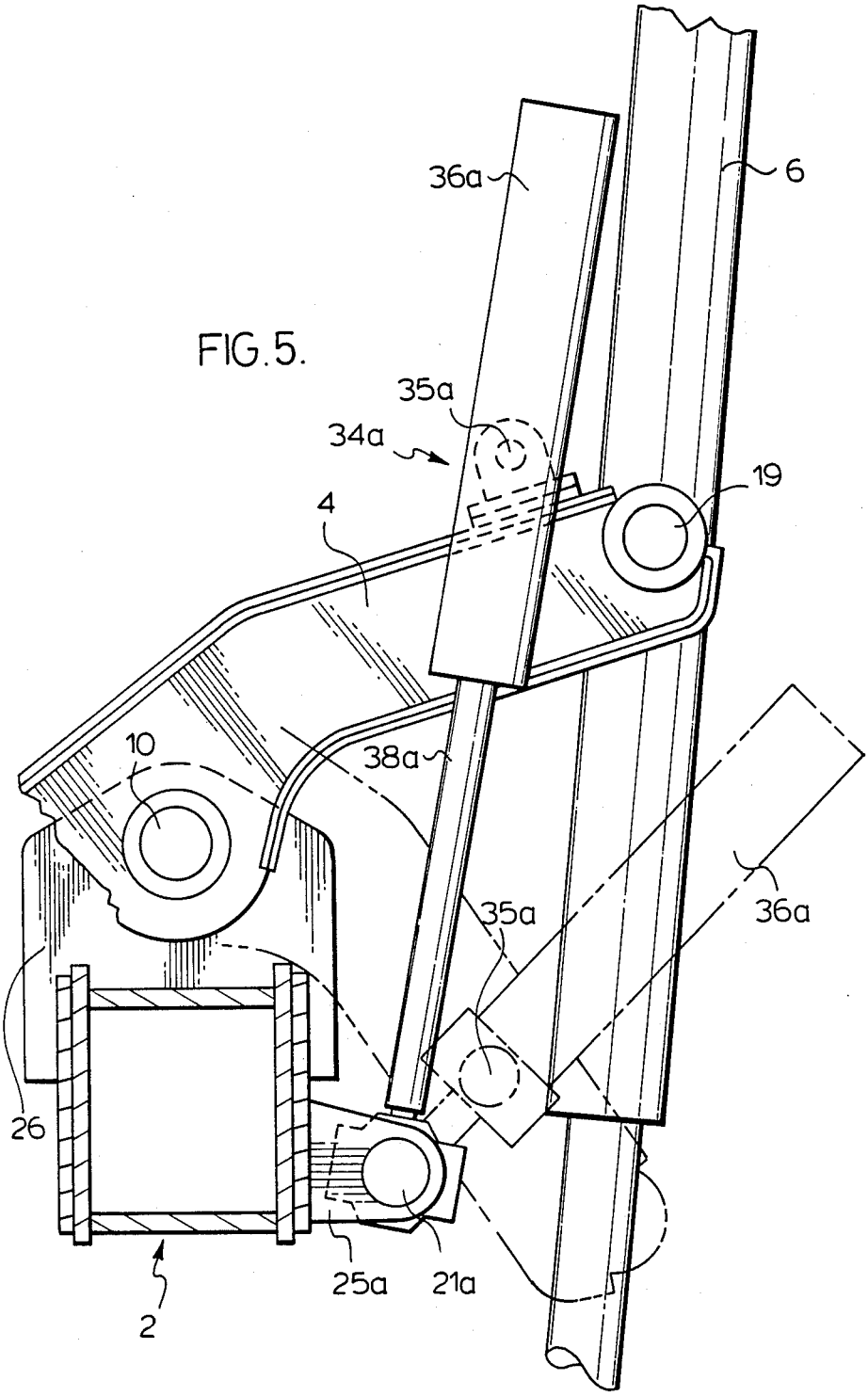
FIG. 5 is a front elevational of a modified structure.

A modified arrangement is shown in FIG. 5 wherein the double acting hydraulic cylinder 34 has been relocated and repositioned to improve the load carrying capabilities of the components. The double acting cylinder 34*a* has the piston 38*a* pivotally secured to the frame 2 at 21*a* adjacent the lower edge and to one side of the frame by means of brackets 25*a*. The barrel 36*a* is pivotally secured to beam 4 at 35*a* spaced outwardly of shaft 10 and to the same side of the frame as position 21*a*. The point of securement 35*a*is selected to reduce high stress concentrations and avoid cylinder fouling. The triangle formed by the position of securement 35*a*, point 21*a* and shaft 10 results in lower stress than the arrangements of FIG. 1 through 4. This arrangement requires a greater stroke for cylinder 34*a*and, therefore, the orientation of the cylinder has been reversed to extend above beam 4. The lift cylinder 6 is secured to the side of the beam 4, opposite cylinder 34*a*, to minimize the possibility of fouling. Cylinder 34*a* will always remain in the same plane, whereas cylinder 6 does not.

The arrangement of FIG. 5 advantageously separates shaft 10, securement point 35*a* and position 21*a*, to reduce stress. By having shaft 10 above the frame 4, the distance to point 21*a* is increased. Thus, the structural characteristics are improved, although some loss of visibility is suffered due to cylinder 34*a* extending above beam 4. The higher load carrying capability of the arrangement of FIGS. 5 through 7 are preferred.

Again, beam 4 may be fabricated of plate steel in a box type cross-section, in which case, ports top and bottom can be provided and cylinder 34*a* can extend through the beam 4. The simplified shape of the beam 4 makes fabrication from plate steel a competitive alternative to a cast beam.

With the arrangement as shown in the drawings, the grader blade may be positioned to either side of the mainframe 4 and the blade positioned at 90° to either side of the mainframe. Therefore, the support achieves the full flexibility of prior art systems while simplifying the support structure resulting in lower manufacturing costs, improved operating characteristics as well as simplified service in the field. Furthermore, in the preferred embodiment where an hydraulic cylinder is used to lock the beam and cause rotation of the beam as desired, full flexibility in the positioning of the beam under the weight of the blade is accomplished.

Figure 6:
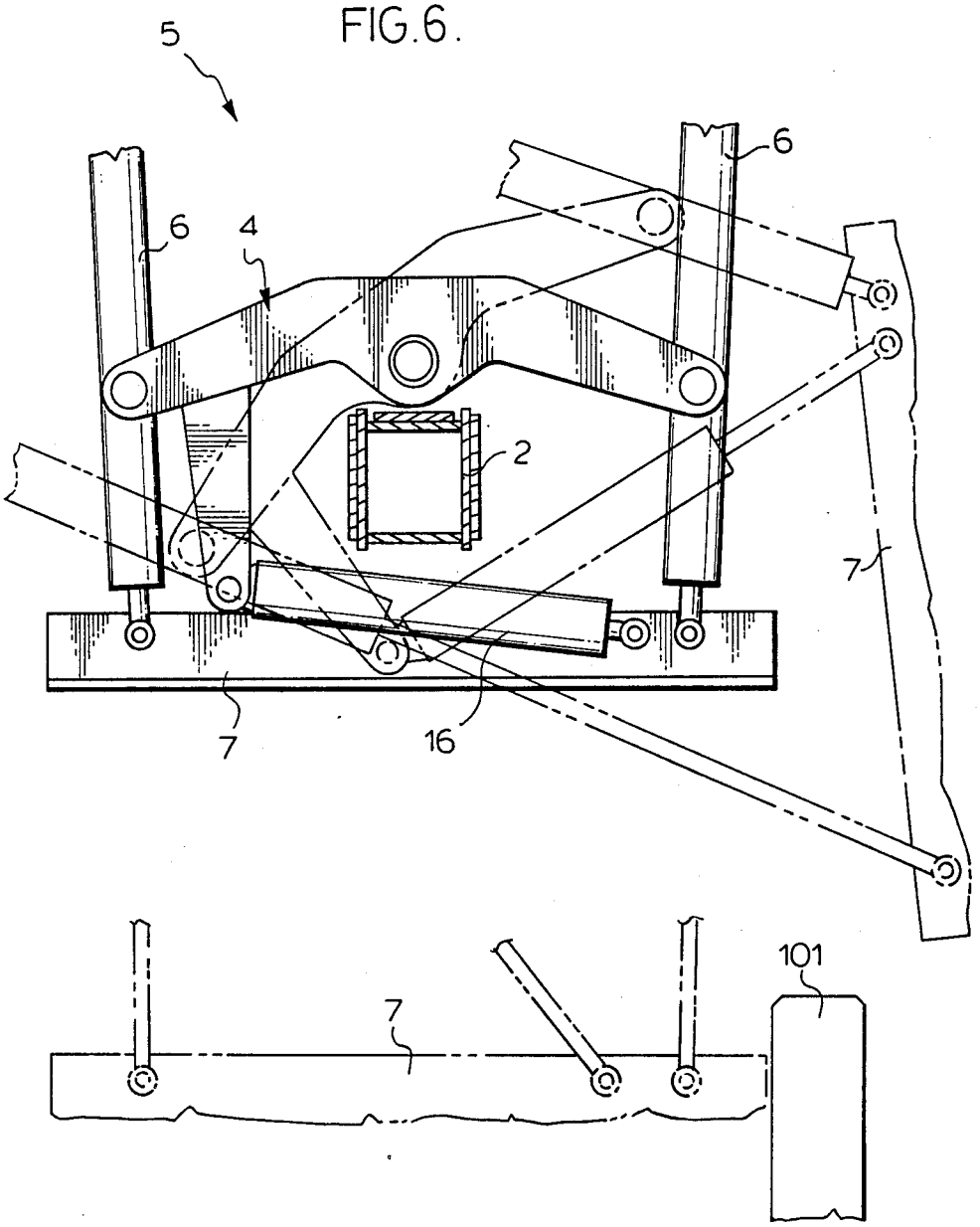
FIG. 6 is a rear view of the high-lift.
Figure 7:
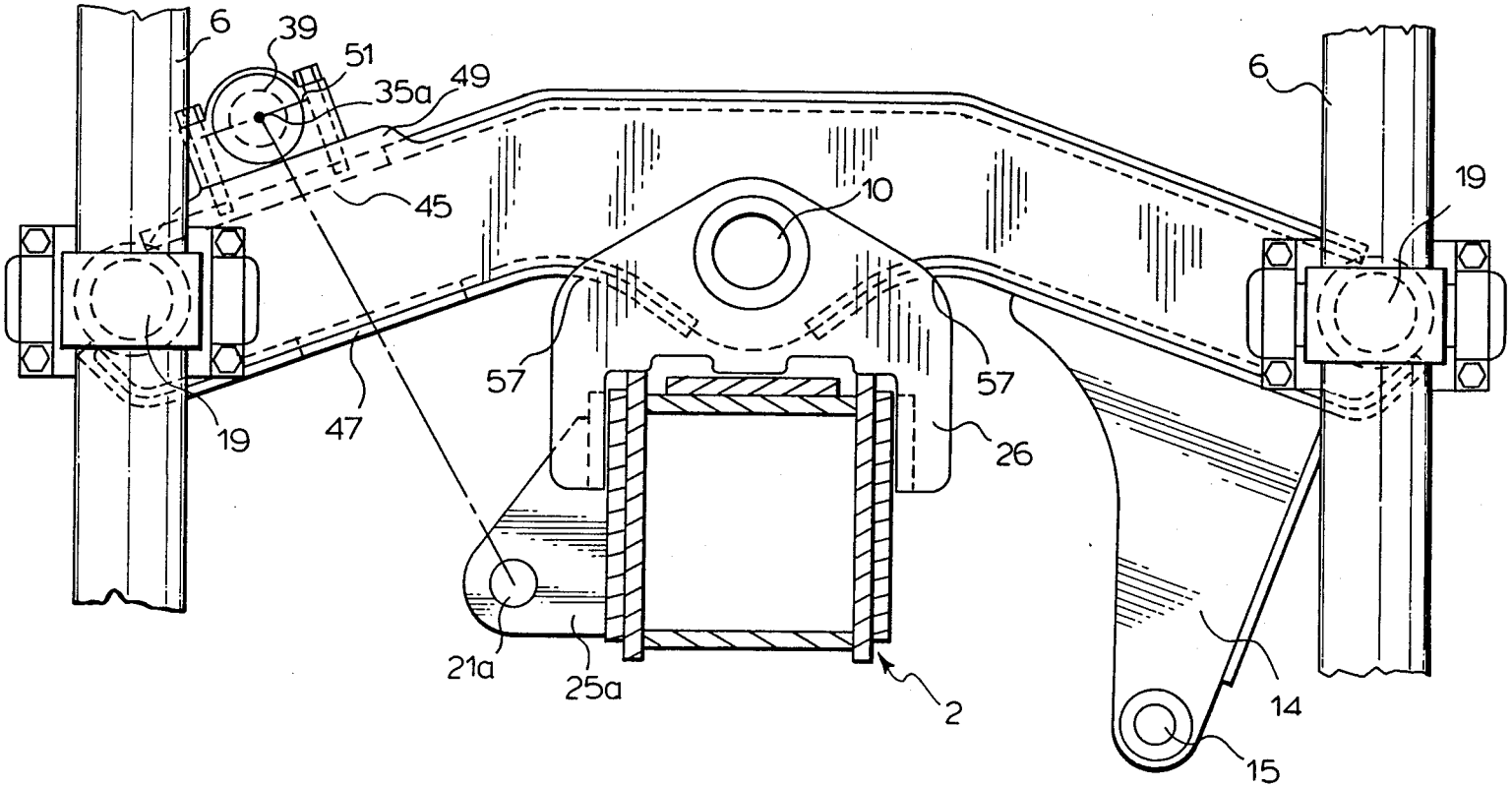
FIG. 7 is a rear view of a modified version of the beam and the connection points of components to the frame.

The blade position in the horizontal beam orientation and rotated for 90° high-lift as well as the blade positions are shown in FIG. 6. FIG. 7 is a rear view of a beam of additional depth and showing details of the mounting of the hydraulic lock cylinder.

The particular geometry is shown in FIG. 6 and includes the points of securement of the lift cylinder 6 to the beam 4, the pivot of the beam, the beam width, the securement of the drag link 16 to the downwardly depending arm 14 and the points of securement of the lift cylinders to the beam 7 and the securement of the drag link 16 to the beam 7. This geometry has proven most satisfactory. The beam 4 spaces the cylinders 6 apart approximately 50 inches at the beam and the lift cylinders are secured to the beam 7 at a spacing of about 48 inches. This causes the cylinders to adopt a neutral position as shown in FIG. 6 where the cylinders are initially angled slightly outwardly to generally follow the progressively opening window of the cab of the grader. The 50 inch spacing of the cylinders either side of the beam is substantially reduced relative to the industry, where a minimum spacing of 52 inches and more normal spacing of 54 inches have been used. The narrower spacing of the beam in combination with the improved clearance beneath the frame and particular location of the points of securement of the lift cylinders below the axis 10 of the beam (about two inches), or at least in line therewith, allows the desired positioning of the blade 90° either side of the grader as well as positioning of the blade for banking at a 2 to 1 or 1 to 1 ratio and a ditching position. The distance between securement of each cylinder 6 to the beam and the end position of the piston portion of the cylinder at maximum stroke is about 70 inches. The height of the cylinder above the beam is such to allow for full retraction of the piston portion of the lift cylinder. The minimum retracted position of the drag cylinder 16 is 38 inches and this cylinder has a stroke of about 27 inches. The point of securement of the drag link 16 to the beam 7 is offset from the center line of the beam and the center line of the grader about 21 inches. The spacing of the lift cylinders on the beam 7 again are symetrical about the center line and are separated 48 inches. The upper securement of the drag link 16 to the depending arm 14 is about 19½ inches below the horizontal passing through the axis 10 and is offset from the center line of the beam about 16¼ inches. These dimensions are all center line to center line.

This arrangement allows a full 90° high-lift position with the blade approximately 21 inches above the ground and the beam 7 approximately 31 inches above the ground, and the blade is positioned outwardly of the tires 101 of the grader such that the far edge of the blade is about 33 inches from the outer edge of the tire. In order to achieve a 2 to 1 bank sloping position, the cylinders are adjusted with the beam in its fully rotated configuration and this results in the blade being lowered towards the ground and the lower outer tip of the blade will be approximately 6 inches above the ground and located exterior to the tire approximately 20 inches. To effect a 1 to 1 banking sloping operation, the blade moves inwardly whereby the lower tip of the blade is approximately 10 inches spaced outwardly of the tire and again is approximately 6 inches clear of the ground. Therefore, in both the 90° high-lift positions, the 2 to 1 banking position and the 1 to 1 banking position, the lower edge of the blade can be positioned above the ground for working a bank where any excess material can accumulate to the exterior of the tire in the gap between the lower edge of the blade and the tire. Thus, the tire does not ride on the ridge of material that may accumulate and as such, a fairly constant slope can be achieved. With the high-lift in a fully retracted position (solid lines in Figure 6) with the beam horizontally disposed, the bottom of the blade allows a ground clearance of over 17 inches and is movable to a maximum lower position of approximately 20 inches below grade.

One of the problems associated with a pivoted beam high-lift is that the 90° high-lift position should be possible either side of the road grader, and in some prior art arrangements the drag link 16 has been reversible in that it is capable of being secured either side of the center of the beam 7 and the frame 2. Such is not necessary in the present structure where, due to the particular geometry, rotation of the beam to the opposite side and full retraction of the drag link 16 accommodates the 90° configuration to the opposite side of the grader. Thus, to achieve the 90° orientation to one side, the drag link is essentially fully extended and to achieve the 90° to the opposite side, the drag link 16 is essentially fully retracted.

With the hydraulically locked beam shown in FIG. 5, the operator has full flexibility in positioning of the beam 4 for various operations. Specialized applications in the field can take full advantage of this flexibility, however the normal positions of bank sloping at a 2 to 1 slope or 1 to 1 slope or the 90° high-lift either side are possible by fully rotating the beam to the appropriate end position and then adjusting the cylinders. By reducing the spacing between cylinders and the particular securement of the cylinders in combination with the securement of the drag link, problems, associated with cylinders reversing over center which create a lock situation where the cylinders are fighting each other, are greatly reduced in that the movement of one cylinder generally causes the other cylinders to move in the desired manner. This improved cooperation between the cylinders is achieved due to the particular geometry of the system.

In the hydraulically locked beam of FIGS. 5 and 7, several advantages have been achieved by positioning the securement 39 and lock cylinder 36*a* fairly close to the lift cylinder 6 and generally towards the end of the beam 4. The lift cylinder 6 is located to one side of the beam and does not remain in a vertical plane and rotates in certain blade positions over the beam. By positioning the cylinder 36*a* generally close to the point of securement of the lift cylinder 6, the lift cylinder is displaced forwardly or rearwardly of the hydraulic lock cylinder 36*a* and this spacing is sufficient to ensure that these cylinders do not foul. As cylinder 6 does rotate through a certain angle, the distance moved does increase as you extend outwardly of the point of securement and, therefore, positioning of the cylinder 36*a*at a more inwardly position could result in a fouling situation. The cylinder 36*a* preferably has a stroke about 18 inches and is spaced outwardly of the axis 10 approximately 20.75 inches. As discussed earlier, advantages are achieved by positioning the lock cylinder 36*a* towards the end of the beam in that stresses are reduced and the cylinder takes a more effective angle with respect to the frame of the grader. As can be appreciated, forces carried by the cylinder result in both horizontal and vertical loads on the frame as opposed to the more limited vertical loads which result when the cylinder is positioned as shown in FIGS. 2 and 3.

When considering the geometry referred to above, it should be remembered that the downwardly extending arm 14 is rearwardly offset approximately 8 inches relative to the center line of the beam to reduce the chances of fouling and provide sufficient room for the drag link 14.

In the fully retracted position if the high-lift with the beam horizontal, there remains approximately 5 inches of clearance beneath the frame of the grader. This is a result of the stroke of the lift cylinder 6 and the relative securement to the pivotted beam 4 and the fixed beam 7. This clearance is substantially greater when compared to the structure disclosed in our earlier patent.

The composite design of the beam, which allows fabrication from plate steel and allows the hydraulic lock cylinder 36*a* to extend through ports 45 and 47 in the beam, also provides flexibility with respect to selecting an appropriate shape for the design forces. For example, the depth of the beam and the fore and aft direction of the grader can be increased, and if additional width of the beam from top to bottom is necessary, then the pivot position of the beam above the frame of the grader can be increased and the width of the beam then increased. This allows a great deal of latitude with respect to the shaping of the beam for the loads expected to be encountered. The composite design also allows for a reinforcing of the beam in the area of securement of the lock cylinder 36*a* merely by adding additional plates interiorly or exteriorly. These additional plates are necessary due to the weakening of the beam due to the porting as well as the forces transferred to the beam by the lock cylinder 36*a*. The cylinder 36*a* is preferably secured to the beam such that the pivot position of the cylinder is above the beam as shown in Figure 7. Mounting blocks 49 welded to the top of the beam and a bearing arrangement 51 securing the lock cylinder is bolted to the mounting blocks 49. This again increases the lever arm and as such, will reduce the stress level on the axis 10 as well as securement of the cylinder to the frame and the stress at the point of securement of the cylinder to the beam. The composite beam construction simplifies securement of the downwardly extending arm 14 and selective reinforcing of the beam to carry the required force. The beam 4 of FIG. 7 is mounted slightly higher above frame 2 to accommodate the shallower radius 57 which can be a high stress area.

A fabricated beam 4 is preferred, however a cast beam could also benefit from the improved geometry and cooperation of components.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In a motor grader having a support frame, a drawbar universally secured thereto adjacent the forward end of the drawbar, and a scraper blade rotatably supported at the opposite end of said drawbar, a beam centrally mounted on top of said support frame pivoting about an axis extending in the fore and aft direction of the grader, double acting lift cylinders universally secured to said beam with said lift cylinders located at opposite sides of said frame, a shift cylinder for shifting the opposite end of said drawbar to one of said sides of said frame, and a hydraulic lock arrangement between said beam and said frame, said hydraulic lock arrangement including a hydraulic cylinder to directly maintain the position of said beam as desired and adjust the position thereof, said hydraulic cylinder being pivotally secured to one of said sides of said frame and extending upwardly and outwardly and forming a pivotal connection with said beam, said hydraulic cylinder in a neutral position of said beam relative to said frame wherein the beam is generally symmetrically disposed to extend generally equally to either of said sides of said frame being located to said one side of said frame and leaving the area below said frame and to the side of said frame opposite said one side free of obstruction from said hydraulic cylinder.

2. In the motor grader of claim 1, wherein said beam includes to one side of said fore and aft extending axis a rearwardly and downwardly extending projection fixed to said beam cooperating with one end of said shift cylinder.

3. In a motor grader as claimed in claim 1, wherein said hydraulic cylinder is pivotally secured adjacent a lower side region of said frame and secured to said beam generally at a mid region between the point of securement of the adjacent lift cylinder and the fore and aft axis of said beam.

4. In a motor grader as claimed in claim 1, wherein said hydraulic cylinder is disposed at an angle of about 45° between a lower part of said frame and said beam when said beam is in said neutral position and is secured to said beam generally at a mid region position between the axis of said beam and the point of securement of said lift cylinder to said one side of said frame.

5. In a motor grader as claimed in claim 4, wherein said hydraulic cylinder extends above said beam to accommodate the required stroke of said hydraulic cylinder to cause the beam to rotate between rotation positions about said fore and aft axis.

6. In a motor grader as claimed in claim 4, wherein said beam is of a fabricated plate steel box construction which includes ports top and bottom through which said hydraulic cylinder extends.

7. In a motor grader, the motor grader having a support frame with a drawbar universally secured thereto adjacent the forward end of said support frame and a scraper blade rotatably supported at the opposite end of said drawbar, a high-lift adjustably supporting said blade, said high-lift comprising a beam pivotally secured atop said frame and rotating about an axis above said frame and extending in the longitudinal direction thereof, said beam extending beyond either side of said frame and supporting opposed lift cylinders below said axis to either side of said frame and lock means for locking said beam at at least one of three positions at various angles relative to the grader frame, said lock means being located to one side of said frame and pivotally connected to said beam and pivotally connected to said frame on said one side thereof, said lock means in combination with said beam and said frame forming a fixed 3 bar linkage which maintains a given position of said beam relative to said frame.

8. In a motor grader as claimed in claim 7, including a rearwardly and downwardly extending arm to one side of said beam and supporting one end of a shift cylinder disposed between said rotatably supported blade and said arm, said arm being angled rearwardly to connect with said shift cylinder at a rearward offset position relative to said axis.

9. In a motor grader as claimed in claim 8, wherein said lock means is a fixed length link having a number of apertures therein for cooperating with a pin member to provide a pin connection with any one of said apertures to lock said beam in one of said given positions.

10. In a motor grader as claimed in claim 9, wherein said fixed length link includes 5 apertures for defining a perpendicular orientation of said beam relative to said frame and positions of about 45 and 63 degrees to either side of said frame.

11. In a motor grader as claimed in claim 8, wherein said lock means is a double acting hydraulic cylinder.

12. In a motor grader as claimed in claim 11, wherein said hydraulic cylinder includes a piston portion and a cylinder portion with said cylinder portion pivotally secured to said frame intermediate the cylinder length, and said piston portion is secured to said arm at a position to maintain a generally vertical orientation of said cylinder.

13. In a motor grader as claimed in claim 11, wherein a piston portion of said cylinder is secured to said frame and a cylinder portion is pivotally secured intermediate its length to said beam and extending at an angle to said frame to reduce the forces at the axis of said beam, the point of securement of said beam and cylinder portion and the point of securement of said piston portion and said frame.

14. In a motor grader as claimed in claim 7, wherein said lock means includes a rigid locking link with one end pivotally secured to said beam and secured to said frame at a different position intermediate the length of said rigid locking link by means of a pin structure to thereby lock said beam in one of said at least three positions relative to said frame, said rigid locking link including at least three apertures in the length thereof sized to cooperate with said pin structure to thereby determine the position of said beam relative to said frame.

15. In a motor grader as claimed in claim 14, wherein said rigid locking link is pivotally secured to a lower portion of said frame to one side thereof and extends upwardly and outwardly at an angle to said frame and connected to said beam at a position generally midway between said axis of said beam and the one of said left cylinder to the same side of said frame as said rigid locking link.

16. In a motor grader having a support frame with a drawbar universally secured thereto adjacent the forward end of said support frame and a scraper blade rotatably supported at the opposite end of said drawbar, a high-lift adjustably supporting said blade and comprising a beam pivotally secured atop said frame and rotating about an axis above said frame said axis extending in the longitudinal direction of said frame, said beam extending beyond either side of said frame and supporting opposed lift cylinders on either side of said frame and at a spacing of about 50 inches and less than 52 inches, and lock means for remotely locking said beam at a host of positions at various angles relative to the grader frame, said lock means including a hydraulic double acting lock cylinder located to one side of said frame and pivotally connected to said beam and pivotally connected to said frame on said one side thereof, said lock cylinder in combination with said beam and said frame forming a fixed 3 bar linkage which maintains a given position of said beam relative to said frame.

17. In a motor grader as claimed in claim 16, including a downwardly extending arm to one side of said beam and supporting one end of a shift cylinder disposed between said rotatably supported blade and said arm, said arm being angled rearwardly to connect with said shift cylinder at a rearward offset position relative to said beam, said arm in a neutral position of the beam having the end thereof about nineteen inches below said axis and horizontally offset relative to said axis about sixteen inches.

18. In a motor grader as claimed in claim 17, wherein said hydraulic lock cylinder is secured to said beam on an upper surface thereof adjacent one of said lift cylinders which is secured to one side of said beam.

19. In a motor grader as claimed in claim 18, wherein said hydraulic lock cylinder is spaced outwardly of the axis of the beam about 20 inches.

20. In a motor grader as claimed in claim 16, wherein said lift cylinders are pivotally secured to a support member directly associated with said blade at a spacing of about 48 inches to orientate said left cylinders so as to angle slightly outwardly at the upper portion thereof from the vertical when said beam and said support member are in a neutral position and centered on the longitudinal axis of the frame, said beam in said neutral position being generally symmetrically disposed to extend generally equally to either of said sides of said frame.

* * * * *